US009513585B2

(12) United States Patent
Sone et al.

(10) Patent No.: US 9,513,585 B2
(45) Date of Patent: Dec. 6, 2016

(54) IMAGE FORMING APPARATUS WHICH SETS IMAGE FORMING CONDITION BASED ON CALCULATED EXPOSED AREA POTENTIAL

(71) Applicants: Keita Sone, Tokyo (JP); Tomohide Takenaka, Kanagawa (JP)

(72) Inventors: Keita Sone, Tokyo (JP); Tomohide Takenaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/837,587

(22) Filed: Aug. 27, 2015

(65) Prior Publication Data

US 2016/0103408 A1 Apr. 14, 2016

(30) Foreign Application Priority Data

Oct. 9, 2014 (JP) ..... 2014-208250

(51) Int. Cl.
*G03G 15/00* (2006.01)
*G03G 21/20* (2006.01)
*G03G 15/043* (2006.01)

(52) U.S. Cl.
CPC ..... *G03G 15/5037* (2013.01); *G03G 21/20* (2013.01); *G03G 15/043* (2013.01); *G03G 21/203* (2013.01); *G03G 2215/00054* (2013.01)

(58) Field of Classification Search
CPC ..... G03G 15/5037; G03G 15/5041; G03G 2215/00054; G03G 21/20; G03G 21/203; G03G 15/043; G03G 15/0266; G03G 15/065
(Continued)

(56) References Cited

U.S. PATENT DOCUMENTS 5,049,939 A * 9/1991 Koichi ..... G03G 15/5037 399/48
5,175,584 A * 12/1992 Usui ..... G03G 21/06 399/44
(Continued)

FOREIGN PATENT DOCUMENTS

JP 56150762 A * 11/1981
JP 01209462 A * 8/1989
(Continued)

*Primary Examiner* — Robert Beatty
(74) *Attorney, Agent, or Firm* — Oblon, McClelland, Maier & Neustadt, L.L.P.

(57) ABSTRACT

An image forming apparatus includes a latent image bearer; a charger; an exposure device; a developing device; a potential detector to detect a surface potential at a detection position between an exposure position and a development position on the latent image bearer in a direction of rotation of the latent image bearer; and a potential controller to determine an image forming condition. The potential controller includes a potential calculator to calculate an exposed area potential based on a detected potential smaller in charging polarity than a potential threshold, out of the detected surface potential, and a threshold determiner to set the potential threshold between the exposed area potential and an unexposed area potential of the latent image bearer based on at least one of a change in the unexposed area potential, a change with time of the latent image bearer, and a change in an ambient condition.

20 Claims, 7 Drawing Sheets

(58) Field of Classification Search
USPC ..... 399/43, 44, 48, 49
See application file for complete search history.

(56) References Cited

U.S. PATENT DOCUMENTS

| | | | | |
|---|---|---|---|---|
| 5,805,954 | A * | 9/1998 | Takahashi | G03G 15/0266 399/44 |
| 2003/0091356 | A1* | 5/2003 | Komatsu | G03G 15/5037 399/49 |
| 2007/0110463 | A1* | 5/2007 | Sako | G03G 15/5062 399/45 |
| 2007/0292149 | A1* | 12/2007 | Slattery | G03G 15/065 399/27 |
| 2009/0324267 | A1 | 12/2009 | Yoshida et al. | |
| 2010/0040389 | A1 | 2/2010 | Akatsu | |
| 2011/0091224 | A1 | 4/2011 | Takenaka | |
| 2011/0206394 | A1 | 8/2011 | Takenaka | |
| 2011/0228355 | A1 | 9/2011 | Morita et al. | |
| 2013/0236200 | A1 | 9/2013 | Tanaka et al. | |
| 2014/0270818 | A1 | 9/2014 | Tanaka et al. | |
| 2014/0294412 | A1 | 10/2014 | Tanaka et al. | |

FOREIGN PATENT DOCUMENTS

| | | | |
|---|---|---|---|
| JP | 01214883 | A * | 8/1989 |
| JP | 2003-207957 | | 7/2003 |
| JP | 2004-062170 | | 2/2004 |
| JP | 2006-139180 | | 6/2006 |
| JP | 2009-152766 | | 7/2009 |
| JP | 2010-008960 | | 1/2010 |
| JP | 2010-044215 | | 2/2010 |
| JP | 2010-079290 | | 4/2010 |

* cited by examiner

IMAGE FORMING APPARATUS WHICH SETS IMAGE FORMING CONDITION BASED ON CALCULATED EXPOSED AREA POTENTIAL

CROSS-REFERENCE TO RELATED APPLICATIONS

This patent application is based on and claims priority pursuant to 35 U.S.C. §119(a) to Japanese Patent Application No. 2014-208250, filed on Oct. 9, 2014, in the Japan Patent Office, the entire disclosure of which is hereby incorporated by reference herein.

BACKGROUND

Technical Field

Embodiments of the present invention generally relate to an electrophotographic image forming apparatus, such as a copier, a printer, a facsimile machine, and a multifunction peripheral (MFP) having at least two of copying, printing, facsimile transmission, plotting, and scanning capabilities.

Description of the Related Art

Electrophotographic image forming apparatuses typically include a charger to uniformly charge a surface of a latent image bearer, an exposure device to expose the latent image bearer with light according to image data, thereby forming an electrostatic latent image thereon, and a developing device to develop the electrostatic latent image into a toner image (visible image).

In such image forming apparatuses, image density tends to fluctuate depending on changes in ambient conditions (temperature and humidity) under which the apparatus is used or changes with elapse of time. There are image forming apparatuses that execute so-called process control to attain a stable image density. In the process control, a gradation pattern for image density adjustment is formed on the latent image bearer, and the image density of the gradation pattern on either the latent image bearer or a transfer medium is detected, and image forming conditions are changed according to detection results of the gradation pattern.

Specifically, in the process control, an optical detector (hereinafter "optical sensor") detects the image density of the gradation pattern, and the amount of toner adhering to the gradation pattern is obtained from the detection value output by the optical sensor. Additionally, a developing potential is obtained from an exposed area potential and a developing bias. The exposed area potential means the potential of the electrostatic latent image, which is formed on the latent image bearer to form the gradation pattern. Then, a formula representing the amount of toner adhering (Y axis) relative to the developing potential (X axis) is established as $y=ax+b$, wherein inclination a represents developing $\gamma$, and X axis intercept represents development start voltage Vk (development start voltage).

After the process control is executed, based on the above-mentioned formula, image forming conditions, which include exposure (exposure light amount), a charging bias, the developing bias, and the like, are changed. With this control, the image density is stabilized even when there are changes in ambient conditions (temperature and humidity) or changes with elapse of time.

The exposed area potential in formation of gradation pattern is extracted from the detection results generated by a potential sensor to detect the surface potential of the latent image bearer. For example, the exposed area potential is extracted as follows. Based on a layout distance from an exposure position, where the latent image is written, and a potential detection position of the potential sensor and the surface movement speed (i.e., rotation speed) of the latent image bearer, the exposed area potential is extracted from the detection results of the potential sensor synchronized with the timing at which the latent image of the gradation pattern reaches the potential detection position.

In another example, the exposed area potential is extracted using a potential threshold predetermined in a range between the potential of an unexposed area after uniform charging (hereinafter "unexposed area potential") and the exposed area potential. In this method, the surface potential of the latent image bearer is detected consecutively at regular cycles. The exposed area potential is calculated using the detection results after elapse of a predetermined time after the detection result falls below the potential threshold in the polarity of charged potential.

SUMMARY

An embodiment of the present invention provides an image forming apparatus that includes a latent image bearer; a charger to charge a surface of the latent image bearer; an exposure device to expose the surface of the charged latent image bearer according to image data to form an electrostatic latent image thereon; a developing device to supply toner to the electrostatic latent image on the latent image bearer to develop the electrostatic latent image; a potential detector to detect a surface potential at a detection position disposed, on the surface of the latent image bearer, between an exposure position and a development position in a direction of rotation of the latent image bearer; and a potential controller to determine an image forming condition.

The potential controller includes a potential calculator to calculate an exposed area potential based on a detected potential smaller in charging polarity than a potential threshold, out of the surface potential detected by the potential detector. The exposed area potential means a surface potential of an exposed area of the latent image bearer. The potential controller further includes a threshold determiner to set the potential threshold to a value between the exposed area potential and an unexposed area potential meaning a surface potential of an unexposed area of the latent image bearer after charging by the charger, based on at least one of a change in the unexposed area potential, a change with time of the latent image bearer, and a change in an ambient condition under which the image forming apparatus is used.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
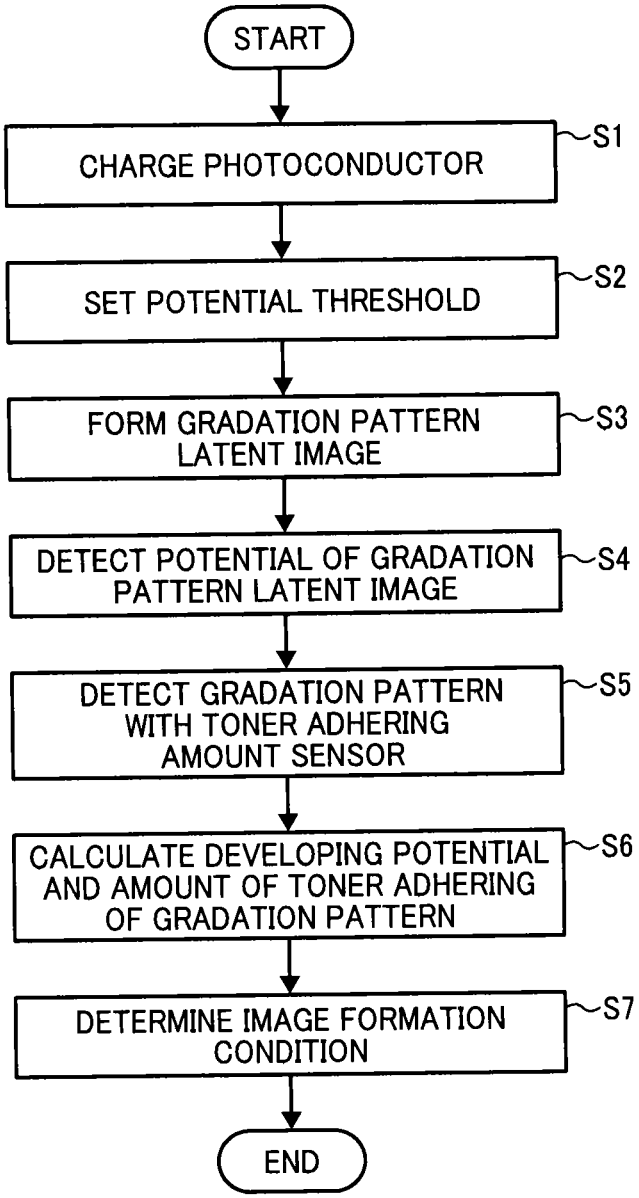
FIG. 1 is a flowchart of process control executed in an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an electrophotographic image forming apparatus according to an embodiment of the present invention is described.

FIG. 1 is a flowchart of process control executed in the image forming apparatus according to the present embodiment, which is described later.

A basic configuration of the image forming apparatus, which in the present embodiment is a printer, for example, is described below.

Figure 2:
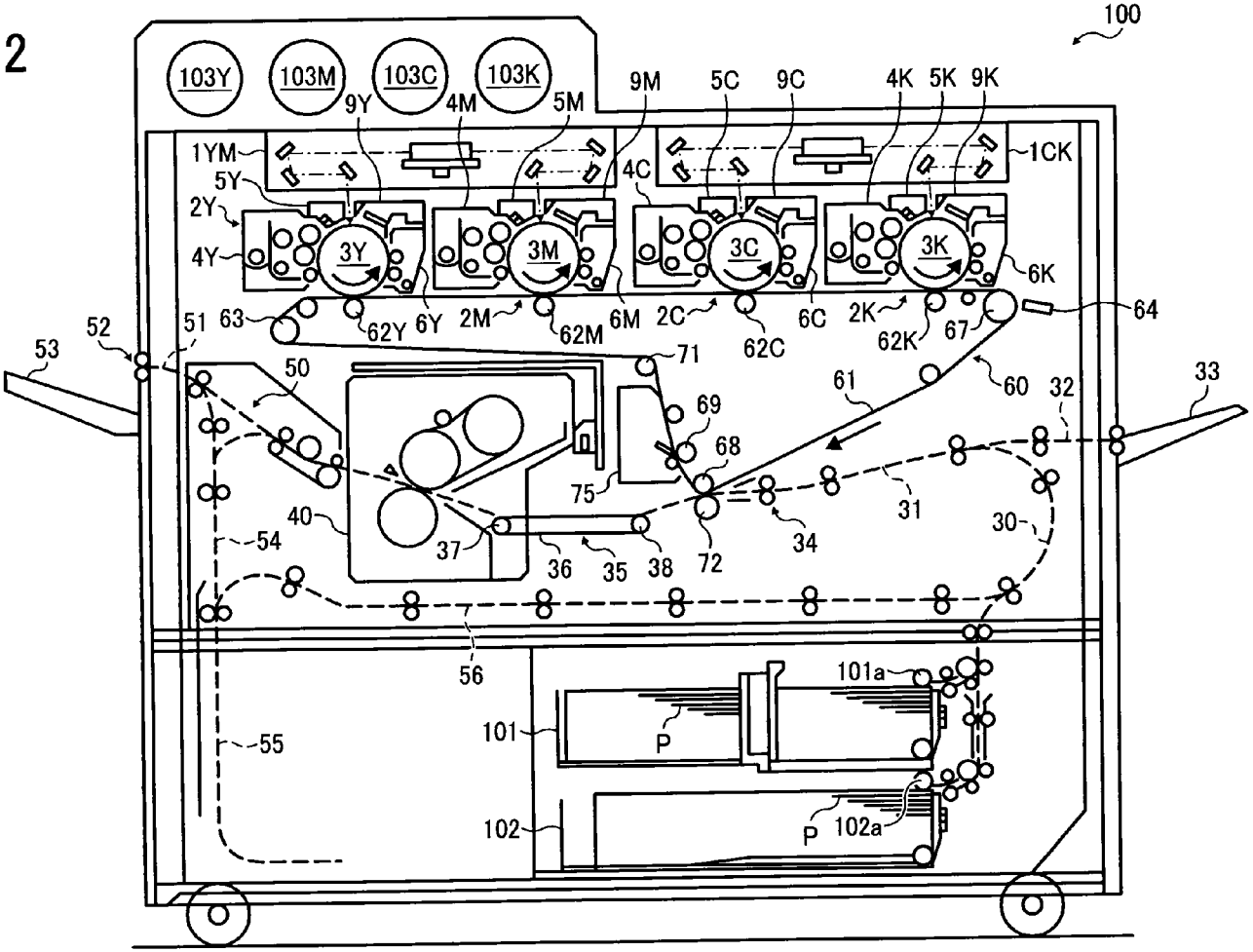
FIG. 2 is a schematic diagram illustrating an image forming apparatus according to an embodiment.

FIG. 2 is a schematic diagram illustrating an image forming apparatus 100 according to the present embodiment.

The image forming apparatus 100 includes two optical writing units 1YM and 1CK (collectively "optical writing units 1") and four process units 2Y, 2C, 2M, and 2K (collectively "process units 2", serving as image forming units) for forming yellow, cyan, magenta, and black toner images. The image forming apparatus 100 further includes a sheet feeding path 30, a conveyance path 31, a bypass path 32, a bypass tray 33, a registration roller pair 34, and a conveyor belt unit 35. Further, the image forming apparatus 100 includes a fixing device 40, a route switching device 50, an ejection path 51, an output roller pair 52, an output tray 53, a first sheet tray 101, a second sheet tray 102, and a sheet reversal device (a resending path 54, a switchback path 55, and a conveyance path 56).

Each of the first and second sheet trays 101 and 102 contain a bundle of transfer sheets P (recording media). As either a first feeding roller 101*a* or a second feeding roller 102*a* rotates, the transfer sheets P in the first sheet tray 101 or the second sheet tray 102 are fed from the top to the sheet feeding path 30. The sheet feeding path 30 leads to the conveyance path 31, through which the transfer sheet P is conveyed immediately upstream from a secondary transfer nip described later. The transfer sheet P fed from the first sheet tray 101 or the second sheet tray 102 passes through the sheet feeding path 30 and enters the conveyance path 31.

On a right side of the image forming apparatus 100 in FIG. 2, the bypass tray 33 is disposed openably and closably relative to a housing of the image forming apparatus 100. In a state in which the bypass tray 33 is open, a bundle of sheets is placed on the bypass tray 33. The transfer sheet P on the top on the bypass tray 33 is fed by a feeding roller to the conveyance path 31.

Each of the optical writing units 1YM and 1CK includes a laser diode, a polygon mirror, and mirrors. The optical writing unit 1 drives the laser diode according to image data, which is captured by a reading device or transmitted from computers. Then, photoconductors 3 (3Y, 3M, 3C, and 3K), serving as latent image bearers, of the process units 2 (2Y, 2M, 2C, and 2K) are scanned with light. Specifically, the photoconductors 3 of the process units 2 are rotated counterclockwise in FIG. 2 by a driving unit.

While deflecting laser beams in the rotation axis direction, the optical writing unit 1YM directs the laser beams to the photoconductors 3Y and 3M that are rotating. With this action, electrostatic latent images respectively corresponding to yellow image data and magenta image data are formed on the photoconductors 3Y and 3M.

Additionally, while deflecting laser beams in the rotation axis direction, the optical writing unit 1CK directs the laser beams to the photoconductors 3C and 3K that are rotating. With this action, electrostatic latent images respectively corresponding to cyan image data and black image data are formed on the photoconductors 3C and 3K.

Each of the process units 2 includes the drum-shaped photoconductor 3 serving as the latent image bearer. In each process unit 2, the photoconductor 3 and the components provided around the photoconductor 3 are supported by a common support, and each process unit 2 is removably installable in the image forming apparatus 100.

The process units 2 are identical in configuration, differing only in color of toner employed. Accordingly, in the description below, the suffixes Y, M, C, and K, each representing the color of toner, are omitted unless color discrimination is necessary.

The process unit 2 includes, in addition to the photoconductor 3, a developing device 4 that develops the electrostatic latent image on the photoconductor 3 into a toner image, a charging device 9 serving as a charger to uniformly charge the surface of the rotating photoconductor 3, and a photoconductor cleaner 6 that removes residual toner remaining on the photoconductor 3 downstream from a primary transfer nip. Further, a potential sensor 5 to detect the surface potential of the photoconductor 3 is disposed at a position opposing the surface of the photoconductor 3 downstream, in the direction of rotation of the photoconductor 3, from a latent image formation position, where the surface of the photoconductor 3 is irradiated with the laser beam from the optical writing unit 1.

The image forming apparatus 100 illustrated in FIG. 2 is tandem type, and the four process units 2 are disposed facing an intermediate transfer belt 61 and arranged side by side in the direction in which the intermediate transfer belt 61 rotates endlessly.

For example, the photoconductor 3 includes an aluminum base pipe and an organic photosensitive layer overlying the base pipe, formed by applying an organic photosensitive material to the base pipe. However, the photoconductor 3 is not limited to the dram-shaped photoconductor and can be a belt type photoconductor.

The developing device 4 develops latent images with two-component developer including magnetic carrier and nonmagnetic toner (hereinafter simply "developer"). Alternatively, developing devices employing one-component developer without magnetic carrier can be adopted. To the developing devices 4 (4Y, 4M, 4C, and 4K), toner supply devices 104 supply yellow, magenta, cyan, and black toners, respectively, contained in toner bottles 103 (103Y, 103M, 103C, and 103K).

The developing device 4 is provided with a toner density sensor 106 (in FIG. 3) to detect density of toner. The toner density sensor 106 detects the magnetic permeability of developer including magnetic carrier, calculates the percentage of toner in developer (i.e., toner density) from the amount of carrier in a given volume, and outputs the calculated toner density as a detection result. Based on the toner density in the developing device 4, obtained by the toner density sensor 106, the toner supply device 104 is controlled to keep the toner density in the developing device 4 within a desired range (for example, about 5% by weight to about 9% by weight).

For example, the photoconductor cleaner 6 includes a cleaning blade made of polyurethane rubber and pressed to the photoconductor 3, but a different type structure can be used. To improve cleaning capability, in the configuration illustrated in FIG. 2, a rotatable fur brush is disposed to contact the photoconductor 3. The fur brush also serves as a lubricant applicator. The fur brush scrapes off lubricant, in powder form, from a solid lubricant and applies the powdered lubricant to the surface of the photoconductor 3.

The process unit 2 further includes a discharge lamp disposed downstream from the photoconductor cleaner 6 and upstream from the charging device 9 in the direction of rotation of the photoconductor 3. The discharge lamp discharges, with irradiation of light, the surface of the photoconductor 3 that has passed by the photoconductor cleaner 6. Then, the surface of the photoconductor 3 is charged uniformly by the charging device 9, after which the optical writing unit 1 performs optical writing. It is to be noted that the charging device 9 rotates while receiving a charging bias from a power supply. Instead of this structure, a scorotron charger disposed contactless with the photoconductor 3 can be used.

Below the four process units 2, a transfer unit 60 is disposed. In the transfer unit 60, the intermediate transfer belt 61, which serves as an image bearer and is an endless belt entrained around multiple rollers 63, 67, 68, 69, and 71, contacts the four photoconductors 3. Among the rollers 63, 67, 68, 69, and 71, the roller 67 serves as a driving roller. As the roller 67 rotates, the intermediate transfer belt 61 rotates clockwise in FIG. 2. The portions where the photoconductors 3Y, 3M, 3C, and 3K are in contact with the intermediate transfer belt 61 are called the primary transfer nips.

Primary transfer rollers 62 (62Y, 62M, 62C, and 62K) are disposed inside a loop of the intermediate transfer belt 61 and adjacent to the primary transfer nips, respectively. The intermediate transfer belt 61 is pressed to the photoconductors 3 by the primary transfer rollers 62. A primary transfer bias is applied to each primary transfer roller 62 from a power supply. Thus, primary transfer electrical fields are formed in the primary transfer nips to electrostatically transfer the toner images from the photoconductors 3 onto the intermediate transfer belt 61.

As the intermediate transfer belt 61 rotates clockwise in FIG. 2 and passes through the four primary transfer nips sequentially, the toner images are superimposed one on another on an outer circumferential surface of the intermediate transfer belt 61 in the primary transfer process. Thus, a superimposed four-color toner image is formed on the intermediate transfer belt 61.

A secondary transfer roller 72 is disposed below the intermediate transfer belt 61 in FIG. 2 and contacts, from outside of the loop, a portion of the intermediate transfer belt 61 entrained around the roller 68 (i.e., a secondary transfer backup roller). The contact portion between the secondary transfer roller 72 and the intermediate transfer belt 61 is called "secondary transfer nip".

A secondary transfer bias is applied to the secondary transfer roller 72 from a power supply, and the roller 68 (i.e., a secondary transfer backup roller) inside the loop of the intermediate transfer belt 61 is grounded. Thus, a secondary transfer electrical field is generated in the secondary transfer nip.

On the right of the secondary transfer nip in FIG. 2, the registration roller pair 34 is disposed. The registration roller pair 34 feeds the transfer sheet P, which is nipped in the registration roller pair 34, to the secondary transfer nip, timed to coincide with the superimposed toner image on the intermediate transfer belt 61. In the secondary transfer nip, the superimposed toner image is transferred secondarily from the intermediate transfer belt 61 onto the transfer sheet P at a time by the secondary transfer electrical field and nip pressure and becomes a full-color toner image on the while transfer sheet P.

Herein, some toner tends to remain on the outer circumferential face of the intermediate transfer belt 61 that has passed through the secondary transfer nip. The toner remaining on the intermediate transfer belt 61 is removed by a belt cleaner 75 disposed in contact with the intermediate transfer belt 61.

After passing through the secondary transfer nip, the transfer sheet P is separated from the intermediate transfer belt 61 and forwarded to the conveyor belt unit 35. In the conveyor belt unit 35, an endless conveyor belt 36 entrained around a driving roller 37 and a driven roller 38 rotates counterclockwise in FIG. 2 as the driving roller 37 rotates. The transfer sheet P is carried on the outer circumferential face of a taut portion of the conveyor belt 36. As the conveyor belt 36 rotates, the transfer sheet P is transported to the fixing device 40.

Then, the transfer sheet P is nipped in a fixing nip, where the toner image is fixed on the transfer sheet P with pressure and heat. Then, the transfer sheet P bearing the toner image on a first side thereof is transported to the route switching device 50.

The image forming apparatus 100 includes the route switching device 50, the resending path 54, the switchback path 55, the conveyance path 56, and the like to transport the transfer sheet P again to the secondary transfer nip. Specifically, the route switching device 50 switches a transport route of the transfer sheet P fed from the fixing device 40 between the ejection path 51 and the resending path 54.

In single-side printing jobs to form the image on only the first side of the transfer sheet P, the ejection path 51 is selected as the transport route of the transfer sheet P. Then, the transfer sheet P bearing the toner image on the first side thereof is transported through the ejection path 51 to the output roller pair 52 and ejected to the output tray 53 outside the apparatus. Similarly, the ejection path 51 is selected as the transport route of the transfer sheet P received after images are fixed on both sides of the transfer sheet P in the fixing device 40, in double-side printing jobs to form the image on both sides of the transfer sheet P. Then, the transfer sheet P bearing the toner images on both sides thereof is ejected to the output tray 53 outside the apparatus.

By contrast, in double-side printing jobs, the resending path 54 is selected as the transport route of the transfer sheet P received after the image is fixed on the first side thereof in the fixing device 40.

The resending path 54 is connected to the switchback path 55, and the transfer sheet P fed to the resending path 54 enters the switchback path 55. When the trailing end of the transfer sheet P in the conveyance direction of the transfer sheet P enters the switchback path 55, the conveyance direction of the transfer sheet P is reversed, and the transfer sheet P is switchbacked. To the switchback path 55, the conveyance path 56 is connected in addition to the resending path 54, and the switchbacked transfer sheet P enters the conveyance path 56. At that time, the transfer sheet P is turned upside down.

The transfer sheet P turned upside down is transported through the conveyance path 56 and the sheet feeding path 30 and fed again to the secondary transfer nip. After the toner image is transferred onto the second side of the transfer sheet P and fixed thereon, the transfer sheet P is transported through the route switching device 50 and the ejection path 51 and ejected by the output roller pair 52 to the output tray 53.

The image forming apparatus 100 further includes toner adhering amount sensors 64Y, 64M, 64C, and 64K disposed to face a portion of the intermediate transfer belt 61 downstream from the primary transfer nip for black and upstream from the secondary transfer nip in the direction of rotation (i.e., travel direction) of the intermediate transfer belt 61. In the present embodiments, the toner adhering amount sensors 64 are reflective optical sensors.

Each toner adhering amount sensor 64 includes a light-emitting element and a light-receiving element. Light emitted from the light-emitting element is reflected by a toner patch on the intermediate transfer belt 61 and received by the light-receiving element. The light received by the light-receiving element is converted into a signal. By analogy of test pattern data according to changes in that signal, the amount of toner adhering to the toner patch is recognized.

Each process unit 2 includes the potential sensor 5 (5Y, 5M, 5C, or 5K) disposed downstream from the position of latent image formation and upstream from a developing range in the direction of rotation of the photoconductor 3. The developing range means a range in which a developing roller faces the photoconductor 3. The potential sensor 5 detects the surface potential of the photoconductor 3 at a position (a potential detection position) facing the potential sensor 5. According to detection results generated by the potential sensor 5, the image forming apparatus 100 recognizes an unexposed area potential and an exposed area potential. In this specification, the term "unexposed area potential" means the surface potential of, on the surface of the photoconductor 3, an area not exposed with the laser light after uniform charging of the photoconductor 3, and "exposed area potential" means the surface potential of an area exposed with the laser light after the uniform charging.

In the image forming apparatus 100, the surface potential of the photoconductor 3 is measured with the potential sensor 5, and the developing potential is calculated from the difference in potential between a developing bias and the exposed area potential (hereinafter "exposed area potential VL") of the photoconductor 3.

The image forming apparatus 100 executes image density adjustment regularly to adjust the image density of each color.

Figure 3:
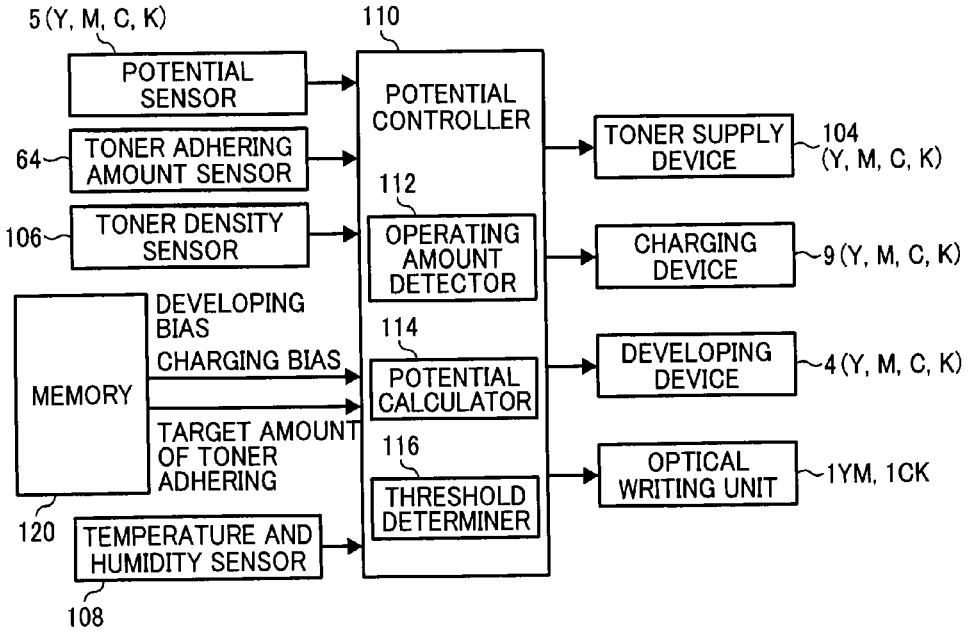
FIG. 3 is a block diagram illustrating electrical circuitry of a controller of the image forming apparatus illustrated in FIG. 2.

FIG. 3 is a block diagram illustrating a part of electrical circuitry of a controller of the image forming apparatus 100.

The controller includes a potential controller 110 to control image density. The potential controller 110 includes a central processing unit (CPU), a read only memory (ROM) to store control programs and various types of data, an operating amount detector 112 to obtain the operating amount of the photoconductor 3, a potential calculator 114, a threshold determiner 116, and the like.

The potential controller 110 determines image forming conditions using data obtained from various sensors illustrated on the left side in FIG. 3 and a memory 120, such as a ROM or a RAM, and determines operating conditions of the various components illustrated on the right side in FIG. 3. The potential controller 110 executes the image density adjustment exclusively with image forming actions and regularly, triggered by a predetermined event such as power-on of the image forming apparatus 100, the start of printing, the cumulative number of printed sheets (e.g., 500 sheets), and completion of printing.

In the image density adjustment, each of the four process units 2 forms a gradation pattern including multiple toner patches different in density, and, the potential sensor 5 detects the potential of the electrostatic latent image for the gradation pattern. Additionally, the amount of toner adhering to each of the toner patches on the intermediate transfer belt 61 is detected using the toner adhering amount sensor 64. Additionally, the toner density sensor 106 detects the toner density in developer (or percentage of toner in developer) inside the developing device 4 during image formation. Based on those detection results, the potential controller 110 calculates the charging bias, the developing bias, and the exposure (amount of exposure light) to attain a target amount of toner adhering.

That is, for each toner patch, the detection value obtained by the toner adhering amount sensor 64, the toner density detected by the toner density sensor 106, and the surface potential of the photoconductor 3 detected by the potential sensor 5 after exposure are input to the potential controller 110. Additionally, the developing bias in formation of each toner patch and the target amount of toner adhering are input to the potential controller 110. Based on such input, the potential controller 110 outputs settings (i.e., image forming conditions) of the charging bias of the charging device 9, the developing bias applied to the developing roller of the developing device 4, the exposure of the optical writing units 1, and the target toner density.

The image forming apparatus 100 attains reliable image density by controlling the various types of biases and toner supply according to the image forming conditions thus output. In toner supply control, the target toner density output from the potential controller 110 is compared with the detection result of the toner density sensor 106. When the toner density obtained from the toner density sensor 106 is lower, the toner supply device 104 is driven to supply toner to the developing device 4.

In the image forming apparatus 100, the gradation pattern including the multiple toner patches different in density is formed on the intermediate transfer belt 61 illustrated in FIG. 2, the amount of toner adhering to the gradation pattern is detected using the toner adhering amount sensor 64, and the above-described image density adjustment is executed.

In the image forming apparatus 100, separately from image formation, the above-described image density adjustment is executed, as process control to adjust the image density of each color, at power-on or after the number of sheets fed reaches a predetermined number.

FIG. 1 is a flowchart of process control executed in the image forming apparatus 100 according to the present embodiment.

In the process control, to detect the image density, the gradation pattern of each color is formed on the intermediate transfer belt 61 by switching the charging bias and the developing bias sequentially to different values (S3 in FIG. 1). Then, light reflected from the gradation pattern is detected by the toner adhering amount sensor 64 disposed adjacent to the roller 67 (driving roller) and facing the outer circumferential face of the intermediate transfer belt 61 as illustrated in FIG. 2, and the output voltage is converted into a signal indicating the amount of toner adhering (S5 in FIG. 1). Further, the potential sensor 5 detects the surface potential of the photoconductor 3. The potential sensor 5 is disposed facing a detection position on the surface of the photoconductor 3, which is downstream from the position of latent image formation and upstream from the developing range in the direction of rotation of the photoconductor 3. Then, the developing potential is calculated as the difference between the exposed area potential VL of the photoconductor 3 and the developing bias (S6).

In the process control, the developing potential (represented by "Vpot" in Formula 1) of the range of each toner patch of the gradation pattern is calculated using Formula 1 below, from the developing bias applied to the developing roller (represented by "Vb" in Formula 1) and the potential of each toner patch on the photoconductor 3 after exposure (exposed area potential VL), detected by the potential sensor 5.

$$V\mathrm{pot}(-V)=Vb(-V)-VL(-V) \qquad \text{Formula 1}$$

Then, from the relation between the amount of toner adhering, obtained by the toner adhering amount sensor 64, and the calculated developing potential Vpot, developing γ representing developing capability, and a development start voltage Vk (development threshold voltage) are calculated. Formula 2 shown below represents the relation between the developing potential (X axis) and the amount of toner adhering (Y axis).

$$y=ax+b \qquad \text{Formula 2}$$

wherein an inclination "a" of linear function is equivalent to the developing γ (developing capability), and the X axis intercept represents the development start voltage Vk. Based on this formula, the image forming conditions, such as the developing bias, are determined.

The exposed area potential VL is calculated based on the detection result of the potential sensor 5, which is data of potential detected cyclically and includes the potential of areas not exposed after uniformly charged (unexposed area potential). Accordingly, the exposed area potential VL is extracted from the detection results of the potential sensor 5.

In the image forming apparatus 100, the exposed area potential VL is extracted using a potential threshold that is set to a value between the unexposed area potential and the exposed area potential VL in formation of one of the multiple toner patches of the gradation pattern. Specifically, the potential sensor 5 consecutively detects the surface potential of the photoconductor 3 at predetermined cycles. Then, the potential calculator 114 of the potential controller 110 calculates the exposed area potential VL using, out of the surface potential detected by the potential sensor 5, the potential value not greater than the potential threshold in the polarity of surface potential of the uniformly charged photoconductor 3 (hereinafter "charging polarity").

If the potential threshold is a predetermined constant, the following inconveniences may arise.

Even if the charging bias applied to the charging device 9 is constant, the potential of the charged photoconductor 3 varies depending on changes with time of the photoconductor 3 or changes in ambient conditions. Additionally, the amount by which the charged potential of the photoconductor 3 is reduced by exposure, that is, the difference between the unexposed area potential and the exposed area potential VL, also changes depending on changes with time of the photoconductor 3 or changes in ambient conditions.

Therefore, even if the potential threshold is set to a value between the unexposed area potential and the exposed area potential VL under a given condition such as the start of use of the image forming apparatus 100, it is possible that the unexposed area potential becomes smaller than the potential threshold in the polarity of charged potential due to changes with time of the photoconductor 3 or changes in ambient conditions. Additionally, it is possible that the exposed area potential VL becomes greater than the potential threshold in the charging polarity of the photoconductor 3. In those cases, since the potential threshold deviates from the range between the unexposed area potential (charged potential) and the exposed area potential VL, calculation of the exposed area potential VL based on the potential threshold is not available.

By contrast, the potential controller 110 according to the present embodiment sets the potential threshold based on at least one of a change in the unexposed area potential (potential of an unexposed area of the photoconductor 3 after charging), a change with time of the photoconductor 3, and the ambient conditions. Then, the potential threshold can be set to a value between the exposed area potential VL and the unexposed area potential on the surface of the photoconductor 3.

Referring to FIG. 1, in the process control, at S1, the charging device 9 charges the photoconductor 3 uniformly. The potential sensor 5 detects the surface potential of the photoconductor 3 at that time, and, at S2, the potential controller 110 sets the potential threshold based on the detection result generated by the potential sensor 5. The potential threshold is set to a value between the unexposed area potential and the exposed area potential VL.

The potential threshold is used to extract the exposed area potential VL of each toner patch range from the data of surface potential of the photoconductor 3 during formation of the gradation pattern. The charging bias used in the uniform charging is set to a value identical or similar to a value in the image forming conditions to attain a top density (image density of a densest toner patch P10 among the multiple toner patches of the gradation pattern), adjusted in previous process control. Additionally, the charged potential in formation of the densest toner patch P10 is set to a value identical or similar to the charging bias in the image forming conditions to attain the top density, adjusted in previous process control. In the present embodiment, the potential threshold is set to a value smaller in negative polarity than the surface potential of the uniformly charged photoconductor 3. This setting inhibits the potential threshold from becoming greater in negative polarity than the charged potential (unexposed area potential) for forming the densest toner patch P10.

In view of the foregoing, the threshold determiner 116 of the potential controller 110 according to the present embodiment sets the potential threshold (represented by "Vth" in Formula 3) such that the following formula is satisfied relative to the potential of the uniformly charged photoconductor 3 (represented by "Vc" in Formula 3, equivalent to the unexposed area potential).

$$V\mathrm{th}(-V)=Vc(-V)-\alpha(-V) \qquad \text{Formula 3}$$

In Formula 3 above, an initial value of reference potential α is, for example, 200 V. With this setting, the potential threshold Vth changes in accordance with the charged potential Vc (unexposed area potential) for forming the densest toner patch P10, and the potential threshold Vth is set to a value smaller in negative polarity than the unexposed area potential by the reference potential α. Accordingly, the unexposed area potential (Vc) is prevented from becoming smaller in the charging polarity of the photoconductor 3 (negative in the present embodiment) than the potential threshold Vth.

Additionally, when the property of the photoconductor 3 changes with elapse of time, it is possible that, even when the surface potential of the photoconductor 3 is identical and the exposure is identical, the decrease in charge amount becomes smaller, and the exposed area potential VL increases and is greater than the potential threshold Vth.

For example, in a case where the unexposed area potential (Vc) for forming the densest toner patch P10 is −300 V and the exposed area potential VL is −150 V, when the potential threshold Vth is calculated with the reference potential α in Formula 3 kept at the initial value of −200 V, the potential threshold Vth is expressed by Formula 4 below.

$$Vth = \text{unexposed area potential } (-300\text{ V}) - \alpha(-200\text{ V}) = -100\text{ V} \qquad \text{Formula 4}$$

In Formula 4, the potential threshold Vth (−100 V) is smaller in the charging polarity of the photoconductor 3 than the exposed area potential VL (−150 V). Therefore, extraction of the exposed area potential VL using the potential threshold Vth is not available.

Such a rise in the exposed area potential VL is caused by, in addition to wear in accordance with increases in rotation distance of the photoconductor 3, environmental changes (e.g., temperature decrease).

In view of the foregoing, the potential controller 110 includes the operating amount detector 112 to obtain the cumulative distance by which the photoconductor 3 has rotated (surface movement distance). From at least one of the rotation distance of the photoconductor 3, obtained by the operating amount detector 112, and temperature and humidity of the ambient environment in which the image forming apparatus 100 is used, the amount by which the exposed area potential VL changes is predicted, and the reference potential α in Formula 3 is adjusted to satisfy VL<Vth<Vc. Then, extraction of the exposed area potential VL is available without being affected by changes in properties of the photoconductor 3 with time or environmental changes.

Regarding adjustment of the reference potential α, as the rotation distance increases, the wear of the photoconductor 3 progresses, and decrease rate (in absolute value) of surface potential decreases even when the surface having an identical unexposed area potential is exposed with identical exposure. Accordingly, to reflect the progress of wear (with elapse of time) of the photoconductor 3 in the control, the potential controller 110 calculates the cumulative rotation distance of the photoconductor 3 from driving data on the photoconductor 3. For example, when the cumulative rotation distance of the photoconductor 3 reaches a distance equivalent to feeding of 10,000 sheets, the reference potential α is calculated by multiplying the initial value with "0.9". When the rotation distance of the photoconductor 3 reaches a distance equivalent to feeding of 20,000 sheets, the reference potential α is calculated by multiplying the initial value with "0.8". For example, the operating amount detector 112 obtains the rotation distance (operating amount) of the photoconductor 3 based on the number of sheets fed, counted by a sheet number counter of the image forming apparatus 100.

Regarding changes in temperature and humidity, under lower temperature and lower humidity, the decrease rate of surface potential tends to decrease even when the exposed is identical. Accordingly, as temperature and humidity decrease, the reference potential α is reduced. The image forming apparatus 100 further includes a temperature and humidity sensor 108 (in FIG. 3) to obtain temperature and humidity data.

Subsequently, a latent image for the gradation pattern is formed (S3 in FIG. 1).

Figure 4:
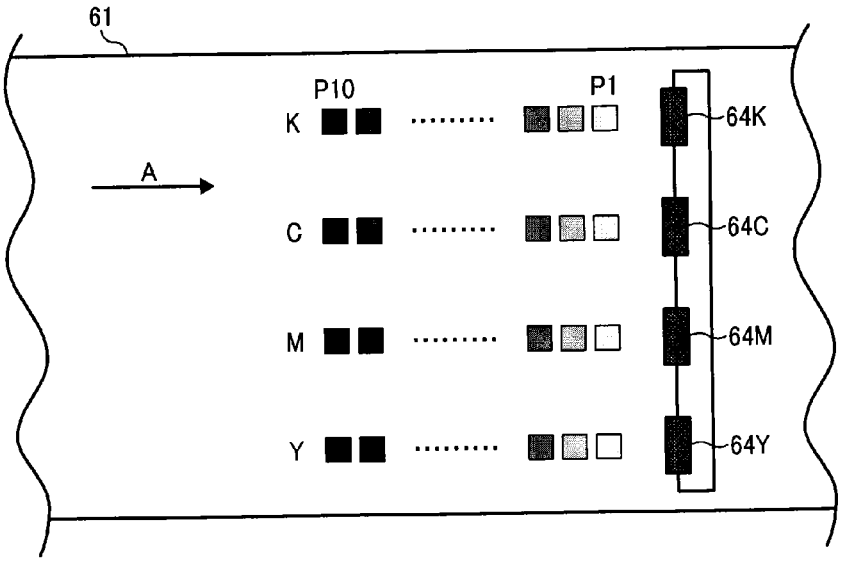
FIG. 4 is a schematic diagram of a gradation pattern on an intermediate transfer belt and toner adhering amount sensors according to an embodiment.

FIG. 4 is a schematic diagram of the black, cyan, magenta, and yellow gradation patterns on the intermediate transfer belt 61 and the toner adhering amount sensors 64K, 64C, 64M, and 64Y to detect the amounts of toner adhering to the gradation patterns. In FIG. 4, arrow A indicates the travel direction of the intermediate transfer belt 61 (belt travel direction).

As illustrated in FIG. 4, each color gradation pattern is formed at a position corresponding to the toner adhering amount sensor 64 of corresponding color in the direction perpendicular to the belt travel direction indicated by arrow A. Each gradation pattern includes ten toner patches P1 through P10 different in image density, and the image density of the toner patches P1 through P10 increase in that order. In the present embodiment, each toner patch in the gradation patterns has a width of 20 mm in a main scanning direction (perpendicular to the belt travel direction indicated by arrow A) and a length of 47 mm (i.e., a patch length W) in a sub-scanning direction (i.e., the belt travel direction indicated by arrow A). Additionally, the toner patches P1 through P10 are at regular intervals (i.e., a patch interval) of 45 mm, for example.

In formation of the gradation pattern, at S4, the potential sensor 5 detects the potential of the latent image for the gradation pattern. After the gradation pattern is developed and transferred from the photoconductor 3 onto the intermediate transfer belt 61, at S5, the toner adhering amount sensor 64 detects the gradation pattern. At S6, the developing potential Vpot and the amount of toner adhering to the gradation pattern are calculated. The toner adhering amount sensor 64 that is an optical sensor is capable of detecting, at desirable sensitivity, the amount of toner adhering in a predetermined detection range. Accordingly, to determine the image forming conditions with high accuracy, it is preferable that the amounts of toner adhering to the multiple toner patches range at equal intervals within the predetermined detection range.

To attain the amounts of toner adhering ranging at equal intervals, for example, the conditions to form each toner patch in the gradation pattern (the developing bias Vb, the charging bias, and the exposure) are determined based on the developing γ calculated in the previous process control such that the amounts of toner adhering to all toner patches fall within the predetermined detection range.

In the image forming apparatus 100 according to the present embodiment, the densest toner patch P10 (last patch) is formed under the image forming conditions to attain the top density, adjusted in the previous process control. The other toner patches are formed such that the amounts of toner adhering thereto range at equal intervals based on the image forming conditions for the densest toner patch P10.

Additionally, in the present embodiment, the exposure position of the densest toner patch P10 is extracted based on the potential threshold Vth, and the exposure positions of other toner patches P1 through P9 are identified considering the layout distance, which is described in detail later with reference to FIG. 7. Based on the surface potential at the identified exposure position, the exposed area potential VL in formation of each toner patch is calculated.

At S5, the toner adhering amount sensor 64 detects the amount of light reflected from each of the toner patches of the gradation pattern. In the present embodiment, the toner adhering amount sensor 64K to detect the black toner patches detects specular reflection of light only, and the toner adhering amount sensors 64C, 64M, and 64Y detect both of specular reflection and diffuse reflection of light. The four toner adhering amount sensors 64 are disposed as illustrated in FIG. 4.

At S6, the developing potential Vpot in formation of each toner patch and the amount of toner adhering to each toner patch are calculated.

Descriptions are given below of the amount of toner adhering, calculated from the output from the toner adhering amount sensor 64 that is an optical sensor.

In the present embodiment, optical sensors including a light-receiving element to receive specular reflection light and a light-receiving element to receive diffuse reflection light are used so that toner patches greater in amount of toner adhering can be detected. In optical sensors, due to changes in temperature or degradation over time, it is possible that output from the light-emitting element changes, or output from the light-receiving element changes. The output of the light-receiving element changes also due to wear over time of the intermediate transfer belt 61 serving as a toner image bearer.

Accordingly, if the amount of toner adhering is calculated from the output from the light-receiving element without calibration, the calculated amount is not accurate. Therefore, in the present embodiment, the optical sensor is calibrated or adjusted, and the amount of toner adhering to the toner patch is calculated from the output of the light-receiving element to receive diffuse reflection light (hereinafter "diffuse reflection receiving element").

In the present embodiment, the amount of toner adhering is calculated using a method described in US20040253012 (A1), which is hereby incorporated by reference herein.

Next, calculation of the developing γ and the development start voltage Vk is described.

The developing potential Vpot of each toner patch is obtained from the exposed area potential VL for forming the toner patch and Formula 1 described above.

The developing γ and the development start voltage Vk are obtained from the relation between the developing potential Vpot and the amount of toner adhering, calculated for each toner patch.

Here, a linear formula is obtained by the least square method with the abscissa representing the developing potential Vpot and the ordinate representing the amount of toner adhering. The inclination of the linear formula is called "developing γ", and the X axis intercept is called "development start voltage Vk".

Next, the developing bias Vb required to attain the target amount of toner adhering is obtained.

Based on Formula 2, which is a linear function, the developing potential Vpot (abscissa) is calculated from the target amount of toner adhering (ordinate). The setting of the target amount of toner adhering to attain the top density is predetermined (typically about 0.4 mg/cm$^2$ to 0.6 mg/cm$^2$, although it depends on coloration degree of toner pigment and toner particle diameter).

Subsequently, the calculated developing potential Vpot is converted into the developing bias Vb using Formula 5 below.

$$Vb(-V)=Vpot(-V)+VL(-V) \quad \text{Formula 5}$$

The value thus obtained in the developing bias Vb of the image area. The charging bias Vc is predetermined such that carrier does not fly to the photoconductor 3. Typically, the developing bias Vb is about −400 V to −750 V, and the charging bias Vc is obtained by adding about 100 V to 200 V (in negative polarity) to the developing bias Vb. The developing bias Vb and the charging bias Vc thus obtained are set as the image forming conditions (S6 in FIG. 1).

Next, the exposure, that is, power (light level) of the laser diode (LD) of the optical writing unit 1 is described below.

Using the developing potential Vpot for attaining the target amount of toner adhering, a halftone potential Vpl to attain a halftone density is calculated using Formula 6 below.

$$Vpl=a\times Vpot+VL \quad \text{Formula 6}$$

In Formula 6, a coefficient "a" is set for the image forming system and determined based on the target halftone density and line width.

After the halftone potential Vpl is calculated, a pattern for adjusting the LD power (exposure) is formed. A dither pattern is used at that time. The pattern is formed while the LD power is changed in multiple steps, with the developing bias Vb and the charging bias Vc fixed. Then, the potential sensor 5 detects the exposed area potential VL of the pattern.

A linear formula is obtained by the least square method with the abscissa representing the LD power (exposure) and the ordinate representing the exposed area potential VL. The LD power for the target halftone potential Vpl is calculated, and the calculated power is set as the LD power in image formation (S6 in FIG. 1).

Figure 5:
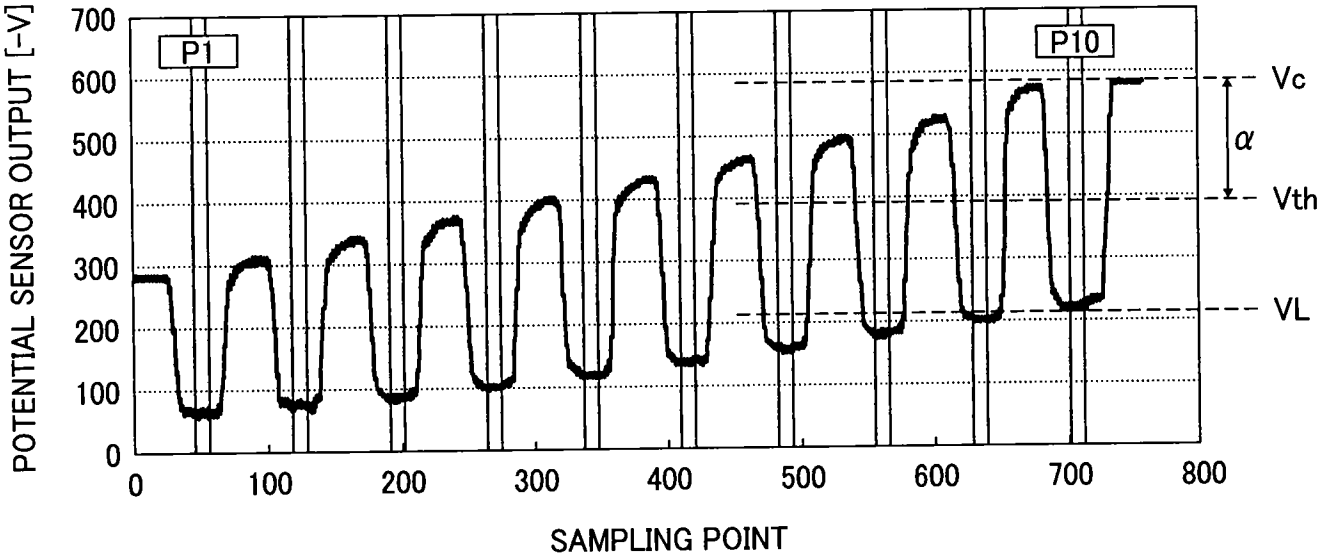
FIG. 5 is a graph of an example result of detection of the gradation pattern detected by a potential sensor according to an embodiment.

FIG. 5 is a graph illustrating an example result of detection of the gradation pattern detected by the potential sensor 5 at step S4 in FIG. 1. The abscissa in FIG. 5 represents sampling points of detection of potential at regular cycles, and the ordinate represents the output of the potential sensor 5 at each sampling point.

In the process control, the gradation pattern is formed while switching the charging bias Vc and the developing bias Vb sequentially to different values such that the image density increases in the order from the toner patch P1 to the densest toner patch P10. Then, the potential at the detection position on the photoconductor 3 during formation of the gradation pattern is sampled at predetermined cycles (sampling cycle described later), and the exposure position of the densest toner patch P10 is detected from the data extracted from the sampled data.

Figure 6:
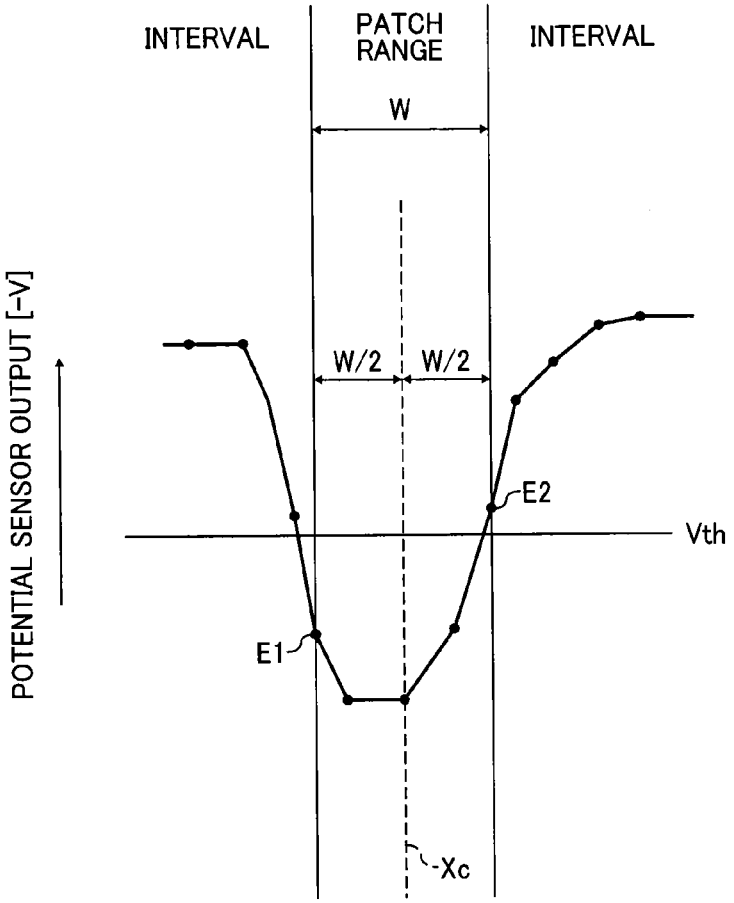
FIG. 6 is a schematic diagram of extraction of an exposure position of a densest toner patch according to an embodiment.

FIG. 6 is a schematic diagram illustrating extraction of the exposure position of the densest toner patch P10.

Initially, out of the sampling results illustrated in FIG. 5, results of a set of sampling points including a sampling point at which the detected surface potential finally falls below the potential threshold Vth and the sampling points before and after that point (the potential becomes greater in negative polarity than the potential threshold Vth).

As illustrated in FIG. 6, out of the set of sampling points, the sampling point at which the detected potential initially falls below the potential threshold Vth is referred to as "patch end E1". Additionally, the sampling point immediately after the set of sampling points, that is, the sampling point at which the detected potential initially exceeds the potential threshold Vth after the detected surface potential has fallen below the potential threshold Vth is referred to as "patch end E2".

In FIG. 6, reference character W represents the length (i.e., "patch length") of the toner patch range (in the direction of rotation of the photoconductor 3), which is equivalent to the distance between the patch end E1 and the patch end E2. Subsequently, a patch center position Xc, which is a center of the patch range in the direction of rotation of the photoconductor 3 is calculated. Specifically, the patch center position Xc is calculated using Formula 7 below, wherein X1 represents the position of the patch end E1, and X2 represents the position of the patch end E2.

$$Xc=(X1+X2)/2 \quad \text{Formula 7}$$

Then, an average of results of a predetermined number of sampling points centered on the calculated patch center position Xc is used as the exposed area potential VL of the toner patch P10.

Although the number of sampling points included in the patch range (between the patch ends E1 and E2) is four in FIG. 6, the graph in FIG. 6 is schematic. It is preferred that the number of sampling points included in the patch range be eight or greater. The predetermined number of sampling points centered on the calculated patch center position Xc is preferably the half of the sampling points included in the patch range or smaller. For example, when the patch range includes eight sampling points, the exposed area potential VL of the toner patch P10 is the average of the potentials detected at the four sampling points (each two before and after the patch center position Xc).

Thus, the exposed area potential VL of the patch range is extracted from the detection results of surface potential lower in negative polarity than the potential threshold Vth, which is advantageous in extracting the exposed area potential VL of the toner patch P10 without being affected by timer error in potential detection by the potential sensor 5.

Next, descriptions are given of calculation of exposed area potentials of the toner patches P1 through P9.

Figure 7:
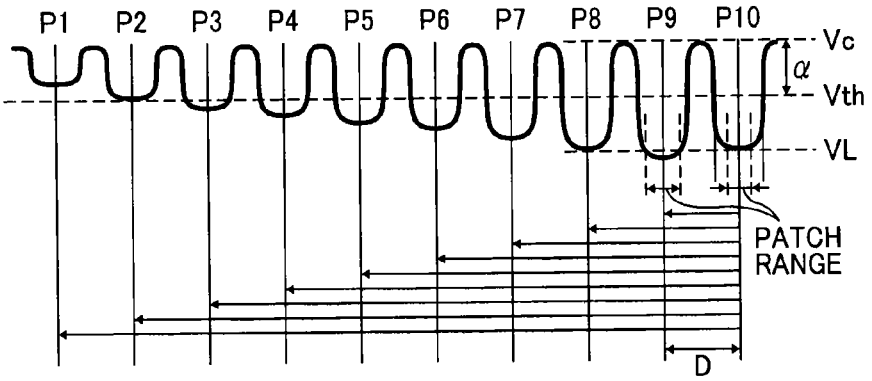
FIG. 7 is a diagram of calculation of an exposed area potential of toner patches according to an embodiment.

Referring to FIG. 7, calculation of the patch center positions Xc of the toner patches P1 through P9 is described.

In FIG. 7, for ease of understanding of the range of each toner patch (range including the potential used to calculate the exposed area potential), the toner patches P1 through P9 are identical in unexposed area potential. However, in practice, the toner patches P1 through P9 are different in unexposed area potential from each other as illustrated in FIG. 5.

A distance between the patch center positions Xc of adjacent toner patches (hereinafter "fixed pitch D") is calculated using a sum of the patch length W of one toner patch in the direction of rotation of the photoconductor 3 and an interval between the toner patches (patch interval Pin). That is, Formula 8 is established.

$$D=W+Pin \quad \text{Formula 8}$$

When a toner patch P10-*m* means the toner patch shifted by "m" to the leading side (to the right in FIG. 4) from the toner patch P10 in the travel direction of the intermediate transfer belt 61, a distance Dm (patch center position distance) between the patch center position Xc of the toner patch P10 and the patch center position Xc of the toner patch P10-*m* is expressed by Formula 9 below.

$$Dm=D\times m \quad \text{Formula 9}$$

It is to be noted that, "m" is "9" in calculation of the distance between the patch center positions Xc of the toner patches P1 and P10, and "m" is "1" in calculation of the distance between the patch center positions Xc of the toner patches P9 and P10.

Additionally, a time difference between formation of the toner patch P10-*m* and formation of the toner patch P10 (patch formation time difference Tm) is expressed by Formula 10 below, wherein S represents the linear speed at which the photoconductor 3 rotates (surface movement speed).

$$Tm=Dm/S \quad \text{Formula 10}$$

Additionally, the difference in number of sampling points between the patch center position Xc of the toner patch P10-*m* and the patch center position Xc of the toner patch P10 ("sampling interval Sm") is expressed by Formula 11 shown below, wherein Ts represents the sampling cycle.

$$Sm=Tm/Ts \quad \text{Formula 11}$$

wherein Sm represents the sampling interval, Tm represents the patch formation time difference, and Ts represents the sampling cycle.

Based on the relations expressed by Formulas 8 through 11, the sampling interval Sm can be expressed by Formula 12 shown below.

$$\begin{aligned} Sm &= \text{patch center position distance } Dm/ \\ &\quad \text{linear speed } S/\text{sampling cycle } Ts \\ &= \text{fixed pitch } D\times m/\text{linear speed } S/\text{sampling cycle } Ts \\ &= (\text{patch length } W+\text{patch interval } Pin)\times m/ \\ &\quad \text{linear speed } S/\text{sampling cycle } Ts \end{aligned} \quad \text{Formula 12}$$

As one example, it is assumed that the sampling interval Sm (m=8) between the toner patch P8 and the toner patch P10, calculated by Formula 12, is 150, and the ordinal number of the sampling point immediately before the patch center position Xc of the toner patch P10 is 700 from the start of detection. In this case, the ordinal number of the sampling point immediately before the patch center position Xc of the toner patch P8 is 550 from the start of detection, and it is identified that the patch center position Xc of the toner patch P8 is between the ordinal number 550 and the ordinal number 551. Then, the average of results of the sampling points centered around the identified patch center position Xc (same as the number of sampling points of the toner patch P10) is used as the exposed area potential VL of the toner patch P8.

Thus, data of exposed area potentials of the toner patches P1 through P9 are calculated.

Data of the patch length W and the patch interval Pin can be obtained from the image forming conditions of the gradation pattern, and data of the linear speed S can be obtained from the control condition of the driving source of the photoconductor 3. The sampling cycle Ts can be obtained from the control condition of the potential sensor 5. If there arises a timer error in potential detection by the potential sensor 5, a deviation is caused between the timing at which the surface of the photoconductor 3 passes by the potential detection position and a recognized timing of passage of the surface of the photoconductor 3 by the potential detection position in the control. Timer error can be caused by increases in processing load on software. In the present embodiment, even if there is a timer error in potential detection by the potential sensor 5, the sampling cycle Ts is constant and is not affected by the timer error. Accordingly, the exposed area potentials VL of the toner patches P1 through P9 are extracted without being affected by such a timer error.

Figure 8:
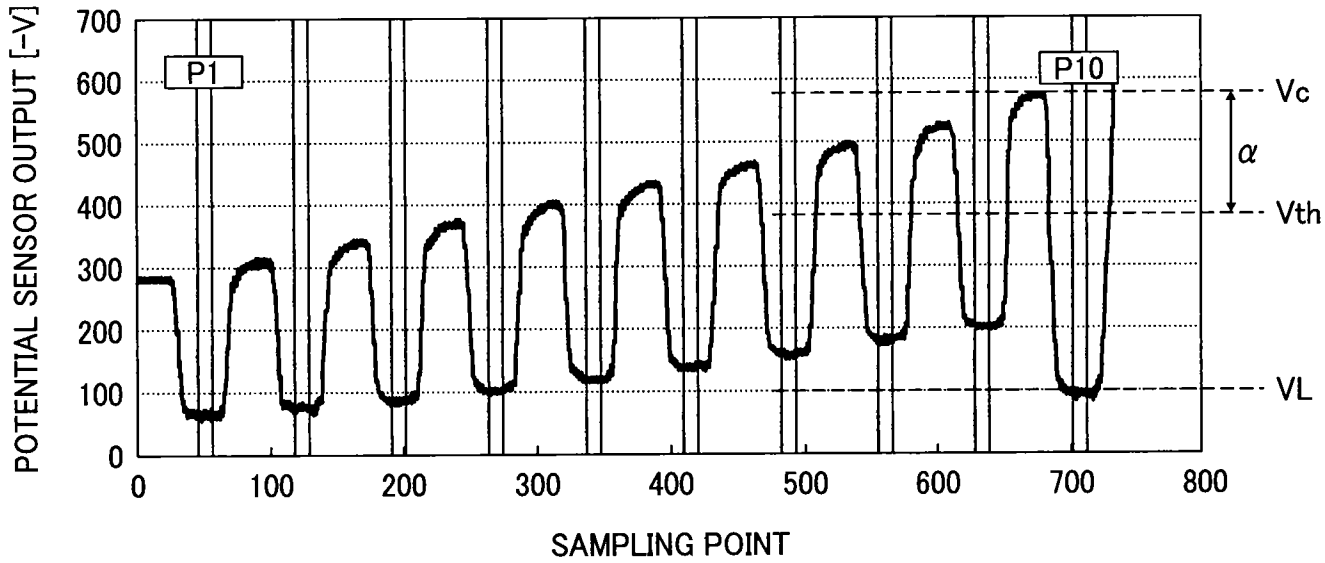
FIG. 8 is a graph of a detection result of the gradation pattern formed with a greater exposure.

FIG. 8 is a graph of the relation between the sampling points and the output from the potential sensor 5 when the toner patches P1 through P9 are formed under the conditions identical or similar to those in FIG. 5 and the exposure is increased in formation of the toner patch P10 from the exposure in FIG. 5.

As illustrated in FIG. 8, by increasing the exposure in formation of the toner patch P10 whose exposed area potential VL is extracted based on the potential threshold Vth, the difference between the unexposed area potential (Vc) and the exposed area potential VL is increased, and the margin of range of the potential threshold Vth is enhanced.

Figure 9:
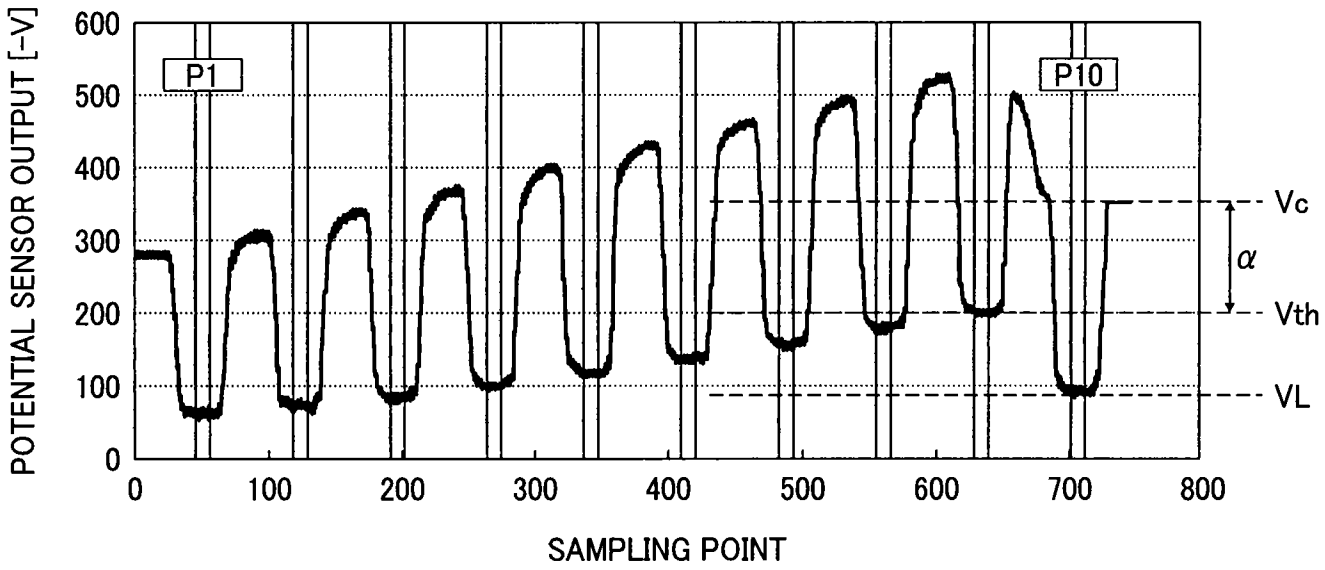
FIG. 9 is a graph of a detection result of the gradation pattern formed with a smaller exposure.

FIG. 9 is a graph of the relation between the sampling points and the output from the potential sensor 5 when the toner patches P1 through P9 are formed under the conditions identical or similar to those in FIG. 5 and the charged potential Vc is reduced in formation of the toner patch P10 from that in FIG. 5.

As illustrated in FIG. 9, when the charged potential Vc (unexposed area potential) is reduced, the potential threshold Vth is set to a value smaller in negative polarity by reference potential "α" from the reduced charged potential Vc (unexposed area potential). Accordingly, on the negative polarity side, the unexposed area potential is prevented from becoming smaller than the potential threshold Vth, and the exposed area potential VL can be detected based on the potential threshold Vth.

It is to be noted that the charged potential Vc is made smaller as illustrated in FIG. 9 in the following method. Detect the potential of the photoconductor 3 uniformly charged under the conditions to attain the top density, adjusted in the previous process control, and then uniformly charge the photoconductor 3 with the charging bias for the toner patch P10 having the reduced charged potential Vc. By detecting the charged potential Vc at that time, the unexposed area potential of the toner patch P10 can be detected.

Regarding the photoconductor 3, there are photoconductors including a surface layer increased in hardness, by addition of filler or the like, to enhance wear resistance. Such photoconductors are advantageous since the operational life is long. However, the inventors recognize that, in such photoconductors, in the range of exposure for image formation, the relation between the exposure and the exposed area potential VL changes with time and changes significantly due to environmental changes. Additionally, the inventors recognize that the relation between the charging bias and the charged potential changes with time and changes significantly due to environmental changes (the charged potential changes with time and due to environmental changes even if the charging device and the photoconductor are the same).

When the relation between the exposure and the exposed area potential VL and the relation between the charging bias and the charged potential Vc change, there is a risk that the predetermined potential threshold Vth deviates from the range between the exposed area potential VL and the unexposed area potential. By contrast, in the image forming apparatus 100 according to the present embodiment, even if the relation between the charging bias and the charged potential Vc changes, the unexposed area potential is detected, and the potential threshold Vth is set in accordance with changes in the unexposed area potential. Accordingly, the potential threshold Vth is prevented from becoming greater than the unexposed area potential on the negative polarity side.

Additionally, even when the relation between the exposure and the exposed area potential VL changes, the potential threshold Vth is set such that the difference between the unexposed area potential and the potential threshold Vth changes in accordance with the changes with time of the photoconductor 3 and changes in ambient conditions, which cause the change of the relation between the exposure and the exposed area potential VL. Specifically, in a case where the negative side potential of the exposed area potential VL is less likely to lower relative to the same exposure, that is, in a state in which the degradation with time of the photoconductor 3 has progressed or the apparatus is used under low temperature and low humidity, the potential threshold Vth is set to reduce the difference between the unexposed area potential and the potential threshold Vth. With this setting, the potential threshold Vth is prevented from becoming greater than the unexposed area potential on the negative polarity side.

It is to be noted that, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The configurations described above are just examples, and each of the following aspects of this specification attains a specific effect.

(Aspect A)

An image forming apparatus such as the image forming apparatus 100 includes a latent image bearer such as the photoconductor 3; a charger such as the charging device 9 to charge a surface of the latent image bearer; an exposure device, such as the optical writing unit 1, to expose the surface of the charged latent image bearer according to image data, thereby forming an electrostatic latent image thereon; a developing device such as the developing device 4 to supply toner to the electrostatic latent image on the latent image bearer to develop the electrostatic latent image; a potential detector, such as the potential sensor 5, to detect a surface potential of the latent image bearer at a detection position between an exposure position, where the exposure device forms the electrostatic latent image, and a development position, where the developing device develops the latent image, in a direction of rotation of the latent image bearer; and a potential calculator, such as the potential controller 110, to calculate the potential of an exposed area on the surface of the latent image bearer, exposed by the exposure device.

The potential calculator calculates an exposed area potential based on a detected potential value smaller than a potential threshold in the charging polarity of the photoconductor 3, such as negative polarity, out of the surface potential detected by the potential detector. The image forming apparatus further includes a threshold determiner to set the potential threshold to a value between the exposed area potential and an unexposed area potential meaning a potential of an unexposed area on the surface of the charged latent image bearer, based on at least one of a change in the unexposed area potential, a change with time of the latent image bearer represented by a cumulative rotation distance of the latent image bearer, and a change in an ambient condition such as temperature, humidity, or both of temperature and humidity.

According to the above-described embodiment, the potential threshold is set based on changes in the unexposed area potential. Accordingly, even when the response of the unexposed area potential to the charging bias changes due to the change with time of the latent image bearer or the ambient condition change, the unexposed area potential is prevented from becoming smaller in the charging polarity of the photoconductor 3 (negative in the present embodiment) than the potential threshold. Additionally, the potential threshold is set considering at least one of the change with time of the latent image bearer and the change in ambient condition, such as temperature and humidity. The change in property of the latent image bearer and the ambient condition change affect the amount by which the surface potential of the charged latent image bearer decreases (decrease rate) by exposure. With this setting, the potential threshold is kept at or greater than the exposed area potential in absolute value regarding the charging polarity.

Thus, according to Aspect A, the potential threshold is set to a value between the unexposed area potential and the exposed area potential regardless of the change with time of the latent image bearer and changes in the ambient condition. Accordingly, according to Aspect A, the exposed area potential is extracted reliably even when the property of the latent image bearer changes with time or the ambient condition changes.

(Aspect B)

In Aspect A, the potential threshold is a difference between the unexposed area potential and a reference potential such as "a" in FIG. 5.

According to Aspect B, as described in the embodiment, since the potential threshold is set based on the unexposed area potential, the potential threshold is kept lower than the unexposed area potential in the charging polarity (such as negative polarity).

(Aspect C)

In Aspect B, the image forming apparatus further includes an environment detector such as the temperature and humidity sensor 108 to detect temperature and humidity inside the image forming apparatus, and the reference potential, such as "a" in FIG. 5, is determined according to the detection result generated by the environment detector.

According to Aspect C, as described in the embodiment, the change in property (such as change amount of the exposed area potential VL) of the latent image bearer is estimated based on the detected temperature and humidity, and the potential threshold is determined considering the estimation. Accordingly, the exposed area potential is extracted without being affected by the change in property of the latent image bearer caused by the environmental changes.

(Aspect D)

In Aspect B or C, the potential controller includes an operating amount detector to obtain the rotation distance of the latent image bearer such as the photoconductor 3, and the reference potential, such as "a" in FIG. 5, is determined according to the rotation distance obtained by the operating amount detector.

According to Aspect D, as described in the embodiment, the change in property (such as change amount of the exposed area potential VL) of the latent image bearer is estimated based on the rotation distance of the latent image bearer, and the potential threshold is determined considering the estimation. Accordingly, the exposed area potential is extracted without being affected by the change with time in property of the latent image bearer.

(Aspect E)

In Aspect A, the image forming apparatus further includes an environment detector such as the temperature and humidity sensor 108 to detect temperature and humidity inside the image forming apparatus, and the potential threshold, such as "charged potential Vc minus $\alpha$ (−V)", is determined according to the detection result generated by the environment detector.

According to this aspect, as described in the embodiment, the change in property (such as change amount of the exposed area potential VL) of the latent image bearer is estimated based on the detected temperature and humidity, and the potential threshold is determined considering the estimation. Accordingly, the exposed area potential is extracted without being affected by the change in property of the latent image bearer caused by the environmental changes.

(Aspect F)

In Aspect A or E, the potential controller includes an operating amount detector to obtain the rotation distance of the latent image bearer such as the photoconductor 3, and the potential threshold, such as "charged potential Vc minus $\alpha$ (−V)", is determined according to the rotation distance obtained by the operating amount detector.

According to this aspect, as described in the embodiment, the change in property (such as change amount of the exposed area potential VL) of the latent image bearer is estimated based on the rotation distance of the latent image bearer, and the potential threshold is determined considering the estimation. Accordingly, the exposed area potential is extracted without being affected by the change with time in property of the latent image bearer.

(Aspect G)

According to any one of Aspects A through F, the potential controller detects a potential of a detection patch, such as the toner patch P10, and the potential controller sets an exposure to an increased value in formation of a latent image for calculation of the potential by the potential calculator (i.e., the latent image for the toner patch P10) from the exposure in image formation according to image data.

According to this aspect, as described above with reference to FIG. 8, the difference between the unexposed area potential and the exposed area potential is increased, and the margin of range of the potential threshold is enhanced.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a latent image bearer;

a charger to charge a surface of the latent image bearer;

an exposure device to expose the surface of the charged latent image bearer according to image data to form an electrostatic latent image thereon;

a developing device to supply toner to the electrostatic latent image on the latent image bearer to develop the electrostatic latent image;

a potential detector to detect a surface potential at a detection position on the surface of the latent image bearer, the detection position disposed between an exposure position and a development position in a direction of rotation of the latent image bearer; and a potential controller to calculate an image forming condition, the potential controller including:

a threshold determiner to set a potential threshold to a value between an exposed area potential and an unexposed area potential, the unexposed area potential being a surface potential of an unexposed area of the latent image bearer after charging by the charger, based on at least one of a change in the unexposed area potential, a change with time of the latent image bearer, and a change in an ambient condition under which the image forming apparatus is used;

a potential calculator to calculate the exposed area potential based on a potential which has been detected by the potential detector, the potential calculator using potentials which are smaller than an absolute value of the potential threshold; and an image forming condition calculator which sets an image forming condition using the exposed area potential which has been calculated, wherein the image forming device forms the images based on the image forming condition which has been set.

2. The image forming apparatus according to claim 1, wherein the potential threshold is a difference between the unexposed area potential and a reference potential.

3. The image forming apparatus according to claim 2, further comprising an environment detector to detect temperature and humidity inside the image forming apparatus, and the potential controller determines the reference potential according to a detection result generated by the environment detector.

4. The image forming apparatus according to claim 2, further comprising an operating amount detector to obtain a rotation distance of the latent image bearer, wherein the potential controller determines the reference potential according to the rotation distance obtained by the operating amount detector.

5. The image forming apparatus according to claim 1, further comprising an environment detector to detect temperature and humidity inside the image forming apparatus, wherein the threshold determiner determines the potential threshold according to a detection result generated by the environment detector.

6. The image forming apparatus according to claim 1, further comprising an operating amount detector to obtain a rotation distance of the latent image bearer, wherein the threshold determiner determines the potential threshold according to the rotation distance obtained by the operating amount detector.

7. The image forming apparatus according to claim 1, wherein the potential controller sets a greater exposure in formation of an electrostatic latent image for calculation of the exposed area potential than an exposure in formation of the electrostatic latent image according to the image data.

8. The image forming apparatus according to claim 1, wherein:

the image forming condition which is set is a charging bias of the charger.

9. The image forming apparatus according to claim 1, wherein:

the image forming condition which is set is used to control the exposure device.

10. The image forming apparatus according to claim 1, wherein:

the image forming condition which is set is used to control a developing bias.

11. An image forming apparatus comprising:

a latent image bearer;

a charger to charge a surface of the latent image bearer;

an exposure device to expose the surface of the charged latent image bearer according to image data to form an electrostatic latent image thereon;

a developing device to supply toner to the electrostatic latent image on the latent image bearer to develop the electrostatic latent image;

a potential detector to detect a surface potential at a detection position on the surface of the latent image bearer, the detection position disposed between an exposure position and a development position in a direction of rotation of the latent image bearer; and circuitry configured to:

set a potential threshold to a value between an exposed area potential and an unexposed area potential, the unexposed area potential being a surface potential of an unexposed area of the latent image bearer after charging by the charger, based on at least one of a change in the unexposed area potential, a change with time of the latent image bearer, and a change in an ambient condition under which the image forming apparatus is used;

calculate the exposed area potential based on a potential which has been detected by the potential detector, the potential calculator using potentials which are smaller than an absolute value of the potential threshold; and set an image forming condition using the exposed area potential which has been calculated, wherein the image forming device forms the images based on the image forming condition which has been set.

12. The image forming apparatus according to claim 11, wherein the potential threshold is a difference between the unexposed area potential and a reference potential.

13. The image forming apparatus according to claim 12, further comprising an environment detector to detect temperature and humidity inside the image forming apparatus, and the potential controller determines the reference potential according to a detection result generated by the environment detector.

14. The image forming apparatus according to claim 12, further comprising an operating amount detector to obtain a rotation distance of the latent image bearer, wherein the potential controller determines the reference potential according to the rotation distance obtained by the operating amount detector.

15. The image forming apparatus according to claim 11, further comprising an environment detector to detect temperature and humidity inside the image forming apparatus, wherein the threshold determiner determines the potential threshold according to a detection result generated by the environment detector.

16. The image forming apparatus according to claim 11, further comprising an operating amount detector to obtain a rotation distance of the latent image bearer, wherein the threshold determiner determines the potential threshold according to the rotation distance obtained by the operating amount detector.

17. The image forming apparatus according to claim 11, wherein the potential controller sets a greater exposure in formation of an electrostatic latent image for calculation of the exposed area potential than an exposure in formation of the electrostatic latent image according to the image data.

18. The image forming apparatus according to claim 11, wherein:

the image forming condition which is set is a charging bias of the charger.

19. The image forming apparatus according to claim 11, wherein:

the image forming condition which is set is used to control the exposure device.

20. The image forming apparatus according to claim 11, wherein:

the image forming condition which is set is used to control a developing bias.

* * * * *